US012560087B2

(12) United States Patent
Bergkvist

(10) Patent No.: US 12,560,087 B2
(45) Date of Patent: Feb. 24, 2026

(54) METHOD, ARRANGEMENT AND MACHINE FOR FULL FACE REAMING

(71) Applicant: BERGTEAMET AB, Boliden (SE)

(72) Inventor: Magnus Bergkvist, Boliden (SE)

(73) Assignee: BERGTEAMET AB, Boliden (SE)

( * ) Notice: Subject to any disclaimer, the term of this patent is extended or adjusted under 35 U.S.C. 154(b) by 128 days.

(21) Appl. No.: 18/562,139

(22) PCT Filed: May 17, 2022

(86) PCT No.: PCT/SE2022/050479
§ 371 (c)(1),
(2) Date: Nov. 17, 2023

(87) PCT Pub. No.: WO2022/250590
PCT Pub. Date: Dec. 1, 2022

(65) Prior Publication Data

US 2024/0240562 A1 Jul. 18, 2024

(30) Foreign Application Priority Data

May 25, 2021 (SE) ..... 2150660-5

(51) Int. Cl.
*E21D 9/11* (2006.01)
*E21D 9/00* (2006.01)

(52) U.S. Cl.
CPC ..... *E21D 9/115* (2013.01); *E21D 9/003* (2013.01)

(58) Field of Classification Search
CPC . E21D 9/11; E21D 9/112; E21D 9/113; E21D 9/115; E21D 9/08; E21D 9/087; E21D 9/10; E21D 9/1006; E21D 9/003
See application file for complete search history.

(56) References Cited

U.S. PATENT DOCUMENTS 901,392 A * 10/1908 Sigafoos
1,723,330 A * 8/1929 Cross ..... E21B 10/06 175/254

(Continued)

FOREIGN PATENT DOCUMENTS

CN 112360496 A 2/2021
DE 1247988 * 8/1967

(Continued)

OTHER PUBLICATIONS

Machine Translation DE 1247988 (Year: 1967).*
International Search Report and Written Opinion for Application No. PCT/SE2022/050479, dated Jun. 13, 2022, 9 pages.

*Primary Examiner* — Sunil Singh
(74) *Attorney, Agent, or Firm* — McCarter & English, LLP

(57) ABSTRACT

A method, an arrangement and a machine for powering holes in mountains through so-called full face reaming. According to the method according to the invention a plurality of cutterheads (20:1-20:n) independently of each other are displaceably moveably accommodated in a drill head (11) by operation of a linear drive arrangement (22:1-22:n) for each cutterhead (20:1-20:n), and which cutterheads from a condition retracted in the drill head (11) are conveyable to a projecting mountain-grinding condition from the front side (11') simultaneously with the drill head (11) rotating, whereby the hole front is gradually drilled along concentric rings "drill rings" that go from an inner smallest circle to an outer largest circle by new cutterheads (20:1-20:n) with gradually increasing radius from the centre of the drill head in successive steps are conveyed in mountain-grinding condition.

15 Claims, 4 Drawing Sheets

(56) References Cited

U.S. PATENT DOCUMENTS

| | | | | | |
|---|---|---|---|---|---|
| 2,754,099 | A | * | 7/1956 | Tracy | E21C 27/22 175/413 |
| 3,887,236 | A | * | 6/1975 | Patrick | E21B 25/10 175/57 |
| 2012/0086260 | A1 | | 4/2012 | Hanaoka et al. | |
| 2017/0101868 | A1 | | 4/2017 | Duhmeq et al. | |

FOREIGN PATENT DOCUMENTS

| | | | | |
|---|---|---|---|---|
| DE | 1914837 | A1 | | 12/1970 |
| DE | 4015492 | | * | 11/1991 |
| EP | 0704600 | A2 | | 4/1996 |
| GB | 1135881 | | * | 12/1968 |
| JP | 8-189296 | A | | 7/1996 |
| WO | 2022/250590 | A1 | | 12/2022 |

* cited by examiner

METHOD, ARRANGEMENT AND MACHINE FOR FULL FACE REAMING

RELATED APPLICATIONS

This application is a 35 U.S.C. § 371 national stage filing of International Application No. PCT/SE2022/050479, filed on May 17, 2022, which in turn claims the benefit of Swedish Patent Application No. 2150660-5, filed on May 25, 2021. The entire contents of each of the foregoing applications are incorporated herein by reference.

TECHNICAL FIELD

The present invention relates to a method and an arrangement for powering holes in mountains through so-called full face reaming. The invention also relates to a full face reaming machine comprising an arrangement according to the invention.

BACKGROUND

Full face reaming machines, also called FRM machines; Shaft Boring Machines, also called SBM machines and Tunnel Boring Machines, also called TBM machines, relate to machines having in common that they are intended for drilling circular cylindrical vertical or horizontal holes in mountains with a pre-determined diameter, without blasting. As an example, it can be mentioned that by grinding a mountain ahead, a machine forms circular holes or tunnels with a final diameter, typically in sizes of 2-10 m. Conceptually, each of the machine types comprises the following main components: a rotatable front drill head, a control system, a support system for the machine, a propulsion system for the machine, a driving system for feeding the drill head forwards, whereby the machine acts as abutment.

The machine equipment is supported by or rests on a number of hydraulically operated tension shoes or "feet" by means of which a drive machinery, a so-called case, having a diameter that is somewhat smaller than the diameter of the drill head, can gradually be moved forwards in the drilling direction. At the very front of the machinery, a rotatable drill head (drill bit) sits, which has the same diameter as the final hole profile. The drill head is rotatably accommodated in a machine housing at the front part of the machine.

The drill head is provided with a plurality of cutterheads, each of which can comprise separately accommodated cutting means in the form of disc-shaped disc cutters with hard metal bits, alternatively the cutting means can be constituted by so-called studs or the like. Usually, disc cutters are used, which are rotatably mounted via a shaft in a retainer (a so-called saddle or body), which is embedded in the drill head. The disc cutters are usually oriented in groups on a front side of the drill head for efficient grinding of the mountain. The disc cutters usually have a shape resembling an ordinary discus disc. The disc cutters are normally fastened in a shaft at the centre of the disc, and via said saddles they are recessedly mounted on the front side of the drill head. The front part of the machine, which carries the drill is tightened onto the side walls of the tunnel or chute with strong hydraulic cylinders that press on said tension shoes adapted according to the radius of curvature of the hole wall. When the FRM machine is pressed firmly against the hole wall, the drilling is initiated, as the drill head is applied by being pressed against the wall of the drilling front, i.e. the chute or tunnel front wall, with strong force, by means of hydraulic cylinders simultaneously with the drill head being rotated in order for said cutterheads on the rotating drill head to be able to penetrate and grind the surface of the mountain. The rest of the machine stands completely still. The disc cutters of each cutterhead are thereby forced rollingly to press with strong force against the mountain wall. The mountain is ground by the disc-shaped disc cutters into flakes that fall down below the drill head and are passed on to the rear end of the machine via a conveyor, usually in the form of a conveyor belt travelling through the entire machine, wherein it can be transported away by being loaded onto carriages that are driven out of the tunnel or on so-called skip hoists or similar lifts conveying the mountain material out of the chute to ground level.

As the disc cutters are the tools with direct contact with the mountain, they are quickly worn and must be replaced regularly. Replacement of disc cutters not only involves high costs for cutting tools as such, but also results in recurring production stoppage as the machine will occasionally have to be taken out of operation, which affects the overall efficiency of the machine.

As mentioned above, hard metal is included in the disc cutters, the life and performance of which are significantly affected by the cutting speed and load to which the disc cutters are exposed. Exceeding the optimum cutting speed (peripheral speed as m/min) of the hard metal cutters leads to a increased loading and temperatures, resulting in a wear mechanism that is usually characterised by occurrence of plastic deformation, i.e. a change in the shape of the cutting edges of the disc cutters. Undershooting the optimum cutting speed also leads to abnormal wear of the cutters. Usually, the load lies in a contact area between the mountain and TBM cutters of about 300 MPa, and the rolling cutting speed V of the disc cutters against the mountain at between 1.4 to 2.9 m/s (84-174 m/min)

The formula for cutting speed V (m/min) is: $\pi \cdot 2r \cdot n$ wherein $\pi \approx 3.14$ r=the radial state of the cutter in terms of metres n=the revolution speed per minute of the drill bit Due to the relatively large diameter of the rotating drill head, it should be understood that for each given revolution speed, the peripheral speed of the disc cutters included in the cutterheads located on the furthest periphery of the drill head during loading against the tunnel front, will operate at relatively high cutting speeds that substantially exceeds the optimum cutting speed (cutting speed>optimum cutting speed), while disc cutters closely connected to the central middle of the drill bit, at loading against the tunnel front, will operate at relatively low cutting speeds, which substantially undershoot the optimum cutting speed. As a result, none of the cutterhead disc cutters located at different radii from the centre of the drill head will operate at optimum cutting speed, which means that the disc cutters on the drill head considered as a whole will be worn prematurely.

In addition to the high cutting speeds occurring at the outer periphery of a drill head, there is an additional problem associated with FRM machines, namely the strong power and moment and holding forces that the machine will have to have in order to be able to drill with large drill heads in terms of diameter. For rotating systems, the mechanical power equals the product of the torque e and the rotational speed w according to the formula:

$$\text{Power } P = M \cdot \omega$$

wherein ω is measured in radians per second (rad/s) and the torque in Newtonmeter (Nm).

It should be understood that the relatively high power required for rotatably driving a drill head with a large diameter in practice restricts the size of the diameter of the holes drilled by an FRM machine, and correspondingly retain the large moment and holding forces necessary for the machine to operate as abutment during the drilling work. Thus, machines for drilling holes with large diameters not only become expensive and complicated, but in practice also difficult to use due to their considerably weight and bulky construction.

It would therefore be desirable to obtain FRM machines that make it possible to drill holes with a large diameter, but which at the same time have a limited power requirement. It is thus desirable to be able to provide inexpensive, compact light-weight FRM machines that can drill holes with large diameters. Moreover, it is desirable to provide FRM machines that can drill mountains of varying quality, also in mountains with many cracks without risk of breakdown or damage caused by large mountain pieces uncontrollably being passed from a drill front.

SUMMARY OF THE INVENTION

A first object of the present invention is to obtain a method making it possible to avoid the problems of FRM machines outlined above, and which also makes it possible to perform drilling in a more efficient manner with drill heads with large diameters and with the desired optimum cutting speed of it or the setting of cutting tools included in each cutterhead in a rotatable drill head.

Another object of the invention is to provide an arrangement with an FRM machine that enables this.

A third object of the invention is to provide an FRM machine that comprises such arrangement.

These objects of the invention are obtained by a method of the type indicated in claims 1-9, an arrangement of the type indicated in claims 10-14 and a full face reaming machine (FRM machine) according to claim 15.

The invention is based on the idea that by arranging the drill head in such a manner, a bottom or front in a bore can be drilled sectionally with radially or diameter-wise increasing width or extent by carrying out the drilling work successively like a target board along concentric rings in sections (so-called drill rings) that go from an inner smallest circle to an outer largest circle. As the bore is driven successively after drill rings, the advantage is obtained that it becomes possible to drill large holes in terms of diameter with relatively little power.

In an embodiment of the invention, the cutterheads independently of each other are displaceably moveably accommodated from a retracted condition in the drill conveyable to a protruding mountain-grinding condition from a front side of the drill head simultaneously with the drill head rotating, whereby a front surface in the bore is gradually drilled along concentric rings "drill rings" that go from an inner smallest circle to an outer largest circle by new cutterheads with gradually increasing radius from the centre of the drill head in successive steps progressing in mountain-grinding condition.

In an embodiment of the invention, the drill parameters, which i.a. comprise cutting speed and feeding force or driving speed forwards can be optimized by the revolution speed of the drill head being adjusted (reduced) according to the drill head at each new drill ring with successively increasing processing radius or diameter towards said front of the mountain.

In an embodiment of the invention, a time is determined for each transition from an inner drill ring to a subsequent outer drill ring with a larger radius by measuring the feeding force Ff (N) or the specific cutting force kc (N/mm2) that is applied on a cutterhead in an inner drill ring. As soon as the operating cutterhead in the inner drill ring no longer meets new mountain, the feeding force on the operating cutterhead will decrease to finally essentially cease completely. When the feeding force on the operating cutterhead against the front falls below a pre-determined limit value, a subsequent outer drill ring is activated by one or a plurality of cutterheads for said subsequent outer drill ring with force is applied against the front.

In another embodiment of the invention, the cutterheads are, independently of each other, displaceably moveably accommodated in the drill head by the effect of a linear drive means arranged for each cutterhead and which cutterheads, from a retracted condition in the drill head by means of said linear drive means, are conveyable to a from a front side of the drill head projecting mountain-grinding conditions simultaneously with the rotation of the drill head.

In an embodiment of the invention, each cutterhead is applied in a drill ring by hydraulic force from a hydraulically operating actuator and control included in a linear drive arrangement arranged in a body of the rotatable drill head.

In another embodiment, the arrangement comprises a swivel coupling for transmitting hydraulic flow between the machinery and an actuator and control included in each linear drive arrangement of the rotatable drill head.

In yet another embodiment replacement of a cutterhead from an inner to an outer drill ring can take place by sensing the application pressure against the front via hydraulic pressure sensors arranged in the linear drive arrangement.

In a further embodiment of the invention, wherein the linear drive arrangement is of a non-hydraulically driven type, it is imaginable that the pressure sensor could be constituted by a wire strain sensor, a load cell or similar sensing elements/sensor that can measure occurring stress of material at loading.

DESCRIPTION OF FIGURES

In the following, the present invention is described in more detail with reference to the accompanying drawings, in which.

DESCRIPTION OF EMBODIMENTS

Figure 1:
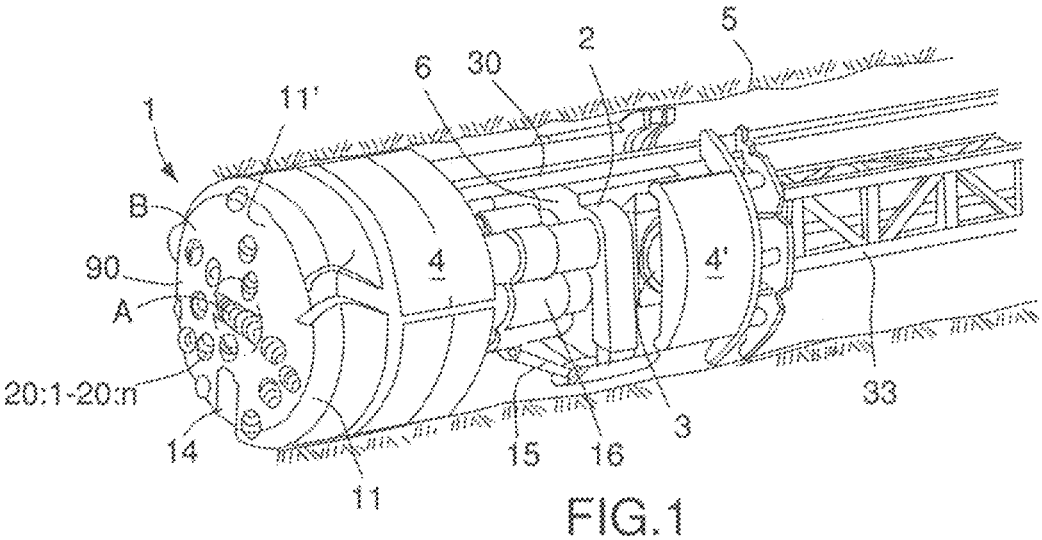
FIG. 1 shows a perspective view of an FRM machine of the tunnel boring machine type, in which a drill head with an arrangement according to the invention is included.

With reference to FIGS. 1-6, an FRM machine of the tunnel boring machine 1 type is shown, comprising a machine housing 2, which by means of hydraulic cylinders 3 and front and rear tension shoes 4, 4' is fastenable in a tunnel 5. The tension shoes 4, 4' can also be used for directional guidance of the FRM machine 1. The FRM machine 1 comprises hydraulically maneuverable support feet 15 on which the machine is supported, while the tension shoes 4, 4' are displaced for repetition against the hole wall. A case 6 is moveable forwards and rewards in the machine housing 2 and is prevented from rotating about its longitudinal axis by the machine housing 2.

Figure 4:
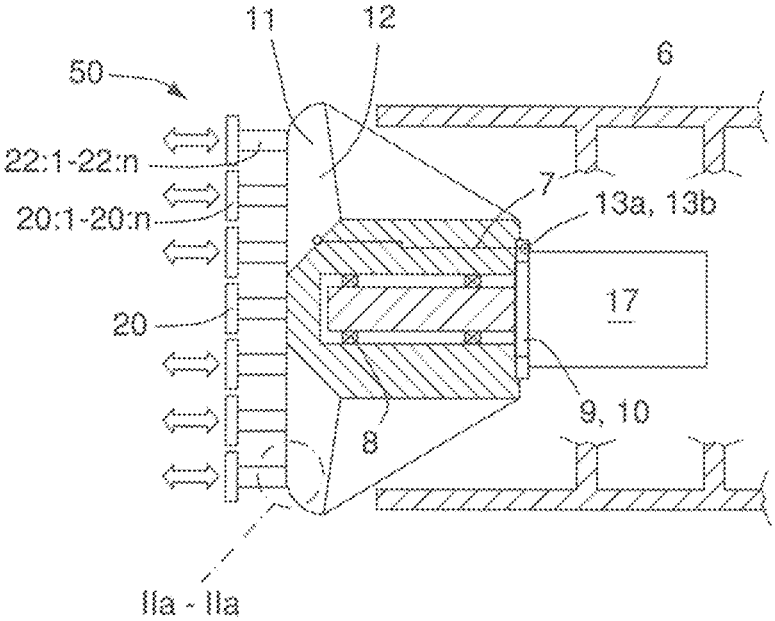
FIG. 4 shows a side view of the drill head in FIGS. 2 and 3 and a portion of a machine housing, in which the drill head is rotatably accommodated in a front portion of the FRM machine.

As most clearly appears from FIG. 4, the machine housing 2 comprises an axis 7, which is rotatably accommodated and supported by bearings 8. At its front end, the axis 7 supports a drill head 11 with a body 12, comprising first and second mounting surfaces 12*a*, 12*b*, respectively, for mounting of the cutterheads 20:1-20*n* on the front surface of the drill head 11. Each such cutterhead 20:1-20:n comprises a saddle 21, which on shaft tabs supports one or a plurality of cutting tools in the form of disc cutters 22.

The case 6 has a diameter that is somewhat smaller than the diameter of the drill head 11, and which successively is to be moved forwards and rearwards, respectively, relative to the drill head 11. During the drilling work, the front end of the drill head 11 is pressed against a front surface 90 in the bore 5 by means of hydraulic cylinders 16, whereby the tension shoes 4, 4' in the case serve as abutment.

Also, with reference to FIG. 4, the machine housing 2, on its end facing away from the drill head 11, is equipped with a transmission 9, comprising a gearbox 10 to which an electric drive motor 12 is coupled. The drive motor 12 has an output shaft (not shown), by which it transfers the torque to the drill head 11 via the transmission 9. A first swivel arrangement is denoted 13*a*, enabling transfer of hydraulic flow to and from the actuator and control 41 comprised in a plurality of linear drive arrangements 22:1-22:n, which are arranged in the body 12 of the rotatable drill head 11 and by which linear drive arrangements a number of cutterheads 20:1-20:n on the drill head 11 with force, optionally and independently of each other, can be applied against the front surface 90. In an alternative embodiment, it is imaginable that the FRM machine 1 comprises a second swivel arrangement 13*b* allowing electrical control signals (analogue or digital) to be transmitted to the body 12 of the drill head 11, which should make it possible to mount required electronically controlled valve packages in the body 12 of the rotatable drill head 11.

The drill head 11 also has one or a plurality of buckets 14 that let fragmented mountain pass from the front surface 90 to the rear side of the drill head 11. A conveying means for taking away fragmented mountain from the front surface 90 ahead of the drill head 11 is denoted 30. The conveying means 30 comprises a first conveyor (not shown) located behind the drill head 11, by which mountain fragments can be scooped up to a higher level, where the mountain fragments fall down onto a second conveyor travelling along the FRM machine in a rearward direction. Furthermore, the conveying means 30 comprises a framework 33 along which said second conveyor such as a belt conveyor or the like travels rearwards.

Figure 2:
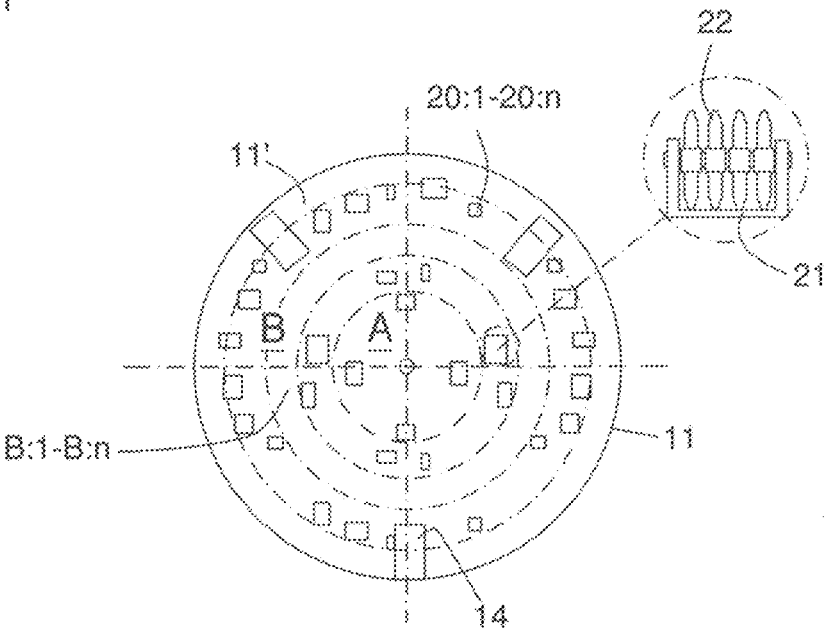
FIG. 2 shows a front view of a drill head with an arrangement according to the invention.

Also, with reference to FIGS. 1 and 2, it is shown how the drill head 11 on its front side 11' has a centrally circular inner and relatively small drill area A with fixed cutterheads 20 that together form a pilot drill with the purpose of obtaining a centring bore in front of the machine. Said fixed cutterheads 20 are mounted on said first mounting surfaces 12*a* in the body 12 of the drill head 11. B denotes a relatively substantially larger, in terms of area, annular radial outer drill area B, which according to the invention is intended to drill sectionally with radially or diameter-wise increasing width or extent, and wherein the drilling work is performed successively on something that can rather be compared with a target board with concentric rings in sections. In the following, said concentrically stepwise drilled annular sections, which go from an inner smallest circle to an outer largest circle of the annular outer drill area B are denoted "drill rings" B:1-B:n.

As shown in FIG. 2, the body 12 of the drill head 11 comprises a number of cutterheads 20:1-20:n that are located so that they form a successive sequence of drill rings B:1-B:n that go from an inner smallest circle to an outer largest circle of the larger annular drill surface B of the front surface 90. In this section, we also refer to the top figure in FIG. 4, wherein it is illustrated how the drill rings B:1-B:n along which the cutterheads 20:1-20:n are intended to be operating by being successively conveyed against the front surface 90 from the drill head 11 are located at an increasing radial distance from the centre of the drill head 11 and outwards. For the peripheral speed to be constant, the revolution speed of the drill bit 11 must thus be reduced gradually as the cutterheads 20:1-20:n are conveyed from the front side 11' of the drill head 11 for generating new drill rings B1-B:n with increasingly larger radius (diameter) in the meeting front surface 90 in the bore.

During hole powering, a cutterhead 20:1-20:n, or a group of jointly operating cutterheads, can successively generate each new drill ring with increased radius by being conveyed from the front side 11' of the drill head 11 and be set in a mountain-grinding or mountain-removing condition against the front surface 90. The force for conveying said cutterheads 20:1-20:n in mountain-grinding condition is obtained from a hydraulically operating actuator and control included in a linear drive arrangement 22:1-22:n arranged for each cutterhead 20:1-20:n. Said hydraulically driven actuator and control 41 included in said linear drive arrangements 22:1-22:n are discretely accommodated in the body 12 of the rotatable drill head 11. Consequently, each cutterhead 20:1-20:n or group of cutterheads can hereby for one to form a drill ring B:1-B:n be driven to mountain-removing application against the front surface 90 simultaneously with the rotation of the drill head 11. As the cutterheads 20:1-20:n are successively conveyed for forming drill rings B:1-B:n with an increasingly larger diameter, which in practice means that the mountain-grinding work is only carried out by the one or the smaller group of cutterheads 20:1-20:n that are operating in the outermost drill ring, it should be understood that the power requirement of the FRM machine, also for drilling with considerable hole diameter becomes very low. As to the latter, it should be understood that the other cutterheads of the drill head certainly rotate along the inner drill rings but without meeting any real resistance, while in practice they rotate freely without performing any mountain-grinding work against the front surface in the bore.

Figure 3:
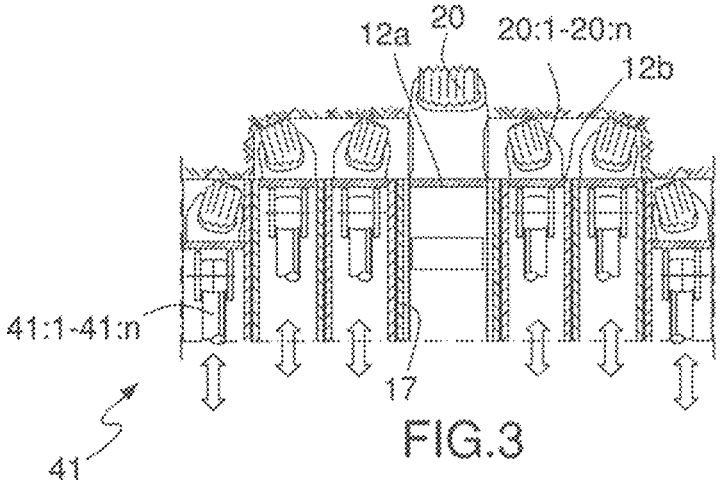
FIG. 3 shows a side view of a drill head included in an FRM machine according to the invention.

As illustrated by double arrows in FIGS. 3 and 4, said linear drive arrangements 22:1-22:n make it possible to bring, forwards or rearwards in the longitudinal or main shaft direction of the machine 1, said respective cutterheads 20:1-20:n in a projected or retracted condition, respectively, as regards the front side 11' of the drill head 11 facing the front surface 90. According to the present invention, said cutterheads 20:1-20:n can, independently of each other, be brought into or out of interaction with the front surface 90 in the bore to successively form new radially larger drill rings B:1-B: n simultaneously with the rotation of the drill head 11 of the machine 1.

Figure 4A:
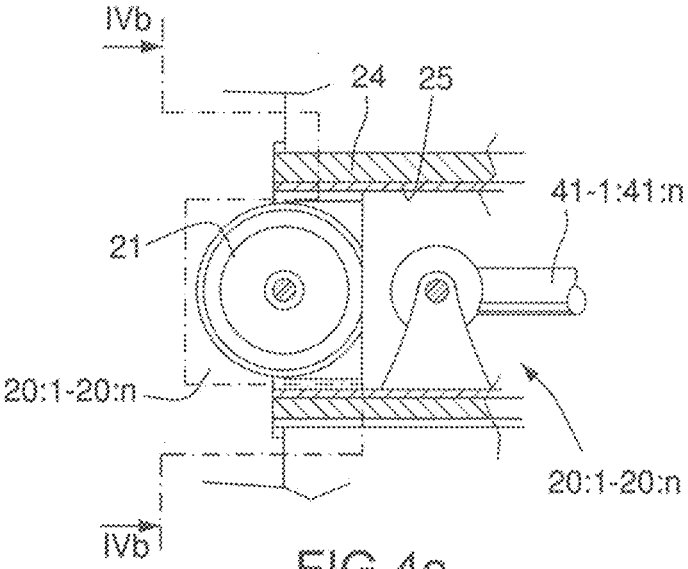
FIG. 4*a* shows a longitudinal sectional view through a linear drive arrangement for a cutterhead with a plurality of disc cutters, which via a saddle are supported at a front end of a slide, with which the cutterhead, along the longitudinal axis of the FRM machine, can be displaced in the forward direction towards a meeting drill front or rearwards, respectively, from the same.
Figure 4B:
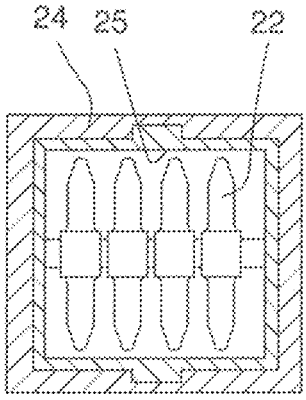
FIG. 4*b* shows a cross sectional view through a cutterhead accommodated in the slide viewed along the line IVb-IVb in FIG. 4*a*.

With reference to FIG. 3 and FIGS. 4*a* and 4*b*, each linear drive arrangement 22:1-22:n for a respective cutterhead 20:1-20:n in the drill head 11 is hydraulically driven. Each linear drive arrangement 22:1-22:n comprises a housing 24, in which a space for controlled accommodation of a slide element 25 that is displaceably moveably controlled in the longitudinal direction of the machine 1. At a front end, the slide element 25 is equipped with said second mounting surface 12*b* for mounting of one (or several) cutterhead(s) 20:1-20:n, each of said cutterheads or in the form of groups of such to form a respective drill ring B:1-B:n. Controlled on a slide element 25, each cutterhead 20:1-20: n can be shifted from a retracted condition in the body 12 of the drill head 11 to a projected condition towards the front surface 90 in the bore. As appears from FIG. 4*a*, a hydraulically driven actuator and control 41 for this in the form of a hydraulic cylinder 41:1-41:n operates between a rear end of the slide element 25 and an abutment in a attachment point of the body 12 of the drill head 11. Also if the linear drive arrangement 22:1-22:n in this exemplary embodiment is hydraulically driven, it should be understood that it could comprise any type of control gear known to the person skilled in the art, for example linear displacement of the slide 25 included in the linear drive arrangement could be executed by means of an electrically powered motor with a connected ball screw mechanism or similar means that can convert a rotational motion to a linear motion.

Figure 6:
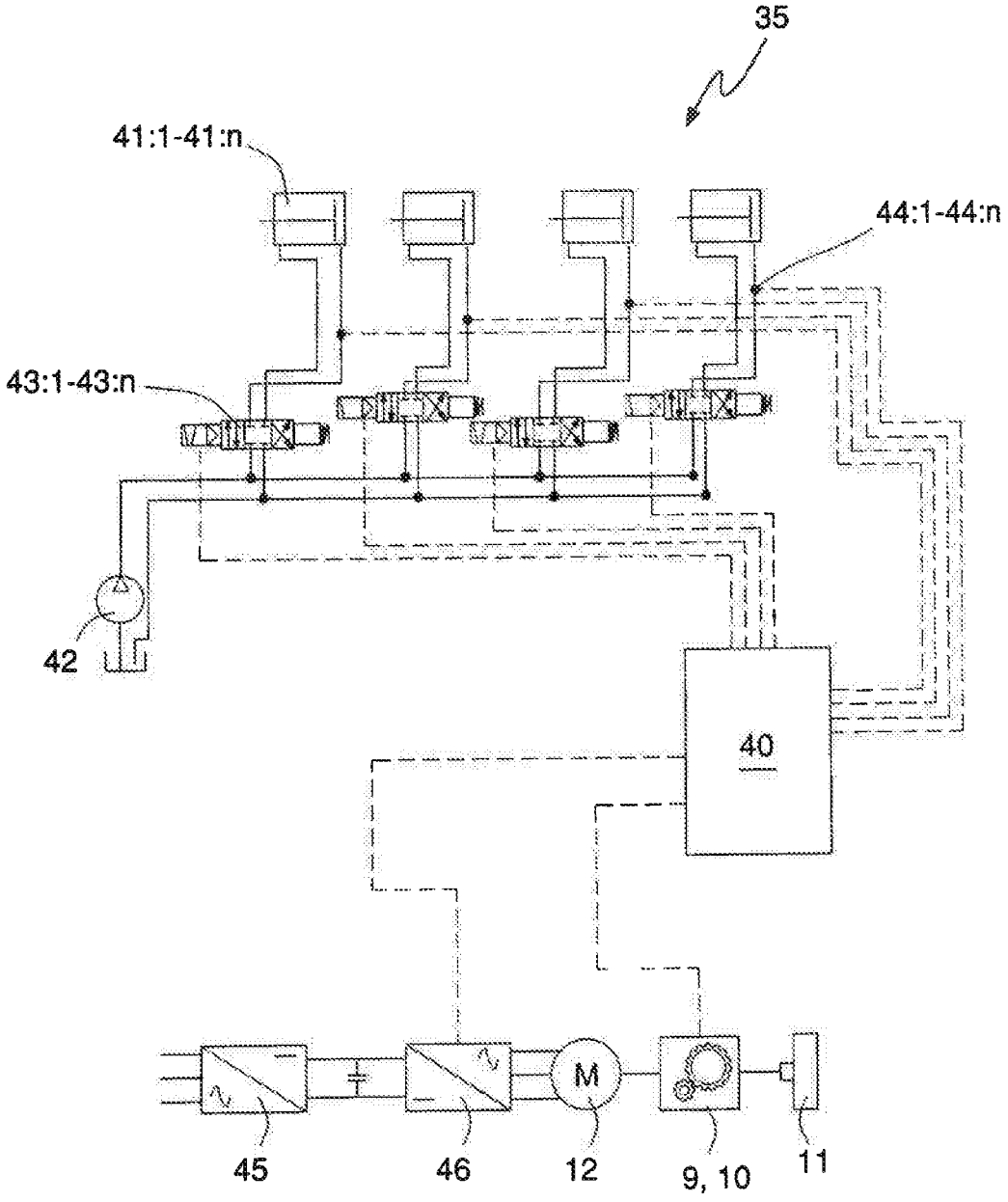
FIG. 6 schematically shows a block diagram of a control circuit for controlling an arrangement included in an FRM machine according to the invention.

With reference to FIG. 6, a schematic view of a control circuit generally denoted 35 for the linear drive arrangements 22:1-22:n included in the present invention is shown. Hydraulic pipes are shown with unbroken lines, and electrical pipes are shown with dashed lines. A control unit is denoted 40, which can be PCL- or PC-based, a respective double-acting hydraulic cylinder is denoted 41:1-41:n, 42 refers to a drive fluid source for hydraulic flow comprising a pump and a tank unit, and 43:1-43:n denote an electric control valve arranged for each hydraulic cylinder, with which the condition of each hydraulic cylinder can be controlled and checked. Moreover, each of the hydraulic cylinders 41:1-41:n are connected to a pressure sensor 44:1-44:n, which can sense a hydraulic pressure on the piston side of each hydraulic cylinder 41:1-41:n as well as a swivel coupling 13*a* for guidance of a hydraulic flow to and from, respectively, each hydraulic cylinder from the drive fluid source. Both the control valves 43:1-43:n and the pressure sensors 44:1-44:n are electrically connected to the control unit 40. Further, said drive motor 12 is included in the control circuit system, which motor is of a three-phase type and arranged to be provided with electric drive power from a grid via a combination of a rectifier 45 and an inverter 46. For rotatable operation, the drive motor 17 is connected with the drill head 11 via the gearbox 10. The control unit 40 is connected with the inverter 46 and the gearbox 10, respectively, via electrical cables, from which it should appear that the revolution speed of the drive motor and hence the revolution speed of the drill head 11 can be varied, partly through frequency control of the drive motor via the frequency deflector, and partly through control of the gearbox in various switch positions. It should be understood that each of the revolution speed control functions above should not necessarily be used in combination.

Figure 5:
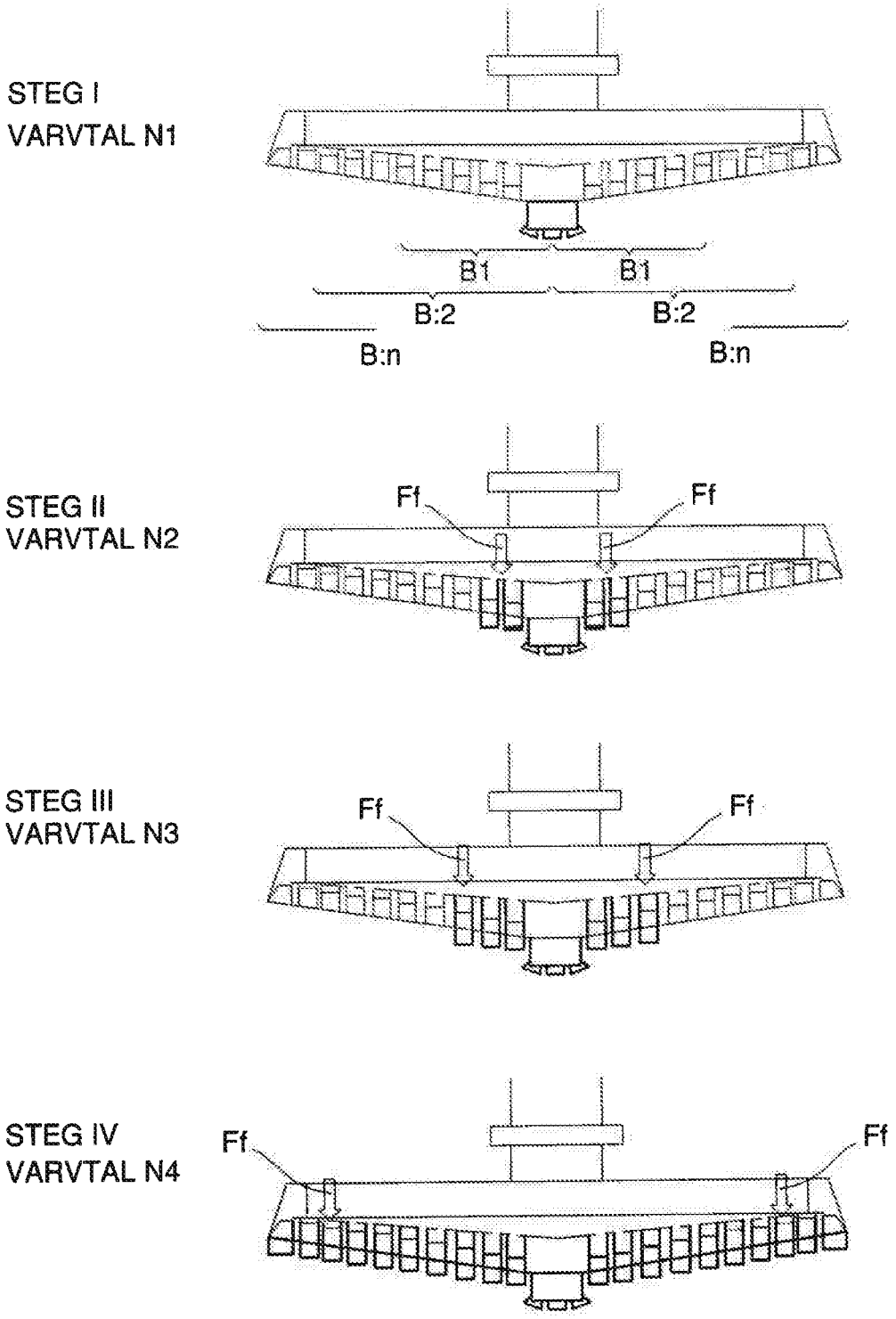
FIG. 5 shows a series of successive steps for a method according to the invention of an FRM machine of the shaft boring machine type, in which a series of "n" cutterheads from a radially inner drill ring to an outer drill ring with force can successively be applied in cooperation with a receiving front surface in a vertical chute in an SBM machine simultaneously with the rotational speed of the drill head is thereby gradually reduced as the effective diameter of the drill head increases.

With reference to FIG. 5, a drill cycle is shown and described according to the invention at a vertically drilling shaft boring machine, in the form of a series of successive steps, denoted step I to step IV, and further a method according to the invention, in which a series of "n" number of cutterheads 20:1-20:n with the associated linear drive arrangement 22:1-22:n can operate along drill rings B:1-B:n that go from an inner smallest circle B:1 to an outer largest circle B:n, by in the axial direction being displaced forwards in mountain-removing contact with the front surface 90 simultaneously with the rotational speed of the drill head 11 being successively reduced at each new drill ring B:1-B:n on a larger radius for maintaining optimum or pre-determined mountain-removing parameters such as cutting speed and/or feeding force.

Step I

"Pilot drilling"—each axially displaceable cutterhead 20:1-20:n in the annular large drilling area B is in a condition retracted in the drill head 11 and thus in a non-mountain-grinding condition relative to the small drilling area A, forming the pilot drilling area. It could be mentioned that in an alternative embodiment of the invention, wherein the pilot drill head for the small drilling area A and the annular outer drill surface B of the drill head 11 is arranged so that they can rotate independently of each other, it is imaginable that only the pilot head is driven rotatably in this initial drilling step. The revolution speed of the drill head 11 is adapted for optimum cutting speed V for the fixed cutterhead 20 of the pilot drill head A (alternatively group of a plurality of cutterheads 20).

Step II

"Drilling of an inner first drill ring B1 with each first cutterhead 20:1 in a mountain-removing projecting condition in the drill head 11, wherein they meet the front surface 90"—and wherein each otherwise non-operating cutterhead 20:2-20:n intended for radially outer bores is 11 retracted in the drill head in a non-operating condition. The revolution speed of the drill head 11 is thereby so adapted that the disc cutters 21 included in each first cutterhead 20:1 for forming a first drill ring obtain desirable optimum cutting speed V. When the feeding force Ff on each first cutterhead 20:1 has fallen below a pre-determined level, the control unit 40 initiates transition to a subsequent drill step (step III).

Step III

"Drilling of an outer second drill ring B2 with each second cutterhead 20:2 in a mountain-removing projecting condition for obtaining a second drill ring with larger radius"- and wherein each otherwise non-operating second cutterhead 20:3-20:n is retracted in the drill head 11 in a non-operating condition. The revolution speed of the drill head 11 is thereby so adapted that the disc cutters 22 included in each second cutterhead 20:2 for forming a second drill ring obtains desirable optimum cutting speed V. When the feeding force Ff on each second cutterhead 20:2 has fallen below a pre-determined level, the control unit 40 initiates transition to a subsequent drill step (step IV).

Step IV

Drilling of a last outer drill ring B3 farthest out on the radius, each third cutterhead 20:3 being in a mountain-removing projecting condition to obtain a third drill ring with larger radius". The revolution speed of the drill head 11 is thereby so adapted that the disc cutters 22 included in each third cutterhead 20:2 for forming a final third drill ring obtains desirable optimum cutting speed V. When the feeding force Ff on each third cutterhead 20:3 has fallen below a pre-determined level, the control unit 40 initiates transition to a subsequent drill step (step IV).

The drilling cycle is completed by all cutterheads 20:1-20:n returning to a non-operating condition retracted in the drill head 11, whereupon the arrangement is ready for a new drilling cycle.

The invention claimed is:

1. A method for powering holes in mountains, the method comprising:

drilling a front surface in a direction forwards by a rotatable drill head having, on a front side, a plurality of mountain-grinding cutterheads which are located at radially different distances from a centre of the rotatable drill head, the plurality of mountain-grinding cutterheads, independently of each other, being displaceable in the rotatable drill head by being operated by a plurality of hydraulic linear drive arrangements arranged for the plurality of mountain-grinding cutterheads, the plurality of mountain-grinding cutterheads being displaceable from a retracted condition in the rotatable drill head, by the plurality of hydraulic linear drive arrangements, to be conveyable to a mountain-grinding condition projecting from the front side simultaneously with rotation of the rotatable drill head, whereby the front surface is drilled in steps in sections along concentric rings of the rotatable drill head which go from an inner smallest circle to an outer largest circle based on successive mountain-grinding cutterheads of the plurality of mountain-grinding cutterheads, with gradually increasing radius from the centre of the rotatable drill head with the rotatable drill head being conveyed in the mountain-grinding condition.

2. The method according to claim 1, wherein a rotational speed of the rotatable drill head is reduced by at least one transition from an inner drill ring of the rotatable drill head with the inner smallest circle to an outer drill ring of the rotatable drill head with the largest outer circle.

3. The method according to claim 2, wherein the rotational speed of the rotatable drill head is reduced at each transition from the inner drill ring of the rotatable drill head with the inner smallest circle to the outer drill ring of the rotatable drill head with the largest outer circle.

4. The method according to claim 2, wherein the rotational speed of the rotatable drill head is reduced at increasing radius from the centre of the rotatable drill head to each successive mountain-grinding cutterhead of the plurality of mountain-grinding cutterheads, or at least to each successive mountain-grinding cutterhead that is located in a projected condition with the rotatable drill head conveyed in the mountain-grinding condition.

5. The method according to claim 1, wherein a feeding force, which, in the drill direction acts on a first mountain-grinding cutterhead in an inner drill ring of the rotatable drill head, is measured during the drilling, and the method further comprises transitioning the drilling to a subsequent outer drill ring of the rotatable drill head, a second mountain-grinding cutterhead of which is located on a larger radius from the centre of the rotatable drill head, when the feeding force of the first mountain-grinding cutterhead in the inner drill ring falls below a pre-determined limit value.

6. The method according to claim 5, further comprising sensing the feeding force acting on the first mountain-grinding cutterhead by a pressure sensor, sensing element, or load cell which can measure an occurring tension of material at loading.

7. The method according to claim 6, whereby the sensing comprises sensing a hydraulic pressure in a drive circuit for at least one of the plurality of linear drive arrangements.

8. The method according to claim 1, further comprising optimizing a cutting speed for each successive mountain-grinding cutterhead conveyed to the mountain-grinding condition by a revolution speed of the rotatable drill head being adapted to the successive mountain-grinding cutterhead located in a drill ring of the rotatable drill head being radially farthest from the centre of the rotatable drill head.

9. The method according to claim 1, wherein the plurality of hydraulic linear drive arrangements for each mountain-grinding cutterhead:

uses hydraulic power from hydraulically operating an actuator and control accommodated in a body included in the rotatable drill head; and is equipped with a hydraulic medium via a swivel coupling which is arranged between the rotatable drill head and a machine housing included in the full face reaming machine on which the rotatable drill head is rotatably supported.

10. An arrangement for powering holes in a mountains the arrangement comprising:

a rotatable drill head for drilling a front surface of the mountain in a forward direction, a front side of the rotatable drill head has a plurality of mountain-grinding cutterheads which are located at radially different distances from a centre of the rotatable drill head, the plurality of mountain-grinding cutterheads, independently of each other, being displaceable in the rotatable drill head by being operated by a plurality of hydraulic linear drive arrangements arranged for the plurality of mountain-grinding cutterheads, the plurality of mountain-grinding cutterheads being displaceable from a retracted condition in the rotatable drill head by the plurality hydraulic linear drive arrangements, to be conveyable to a mountain-grinding condition projecting from the front side simultaneously with rotation of the rotatable drill head; and a control circuit configured to control movements of each of the plurality of linear drive arrangements based on sensing of an application pressure of the front surface.

11. The arrangement according to claim 10, wherein the control circuit is configured to control the movements further based on at least one of the following drilling parameters:

rotation speed of the rotatable drill head; or feeding force of the front surface for each mountain-grinding cutterhead of the plurality of mountain-grinding cutterheads.

12. The arrangement according to claim 10, further comprising a swivel coupling arranged between the rotatable drill head and a machine housing for transfer of hydraulic drive fluid from a pressure fluid source to the plurality of hydraulic linear drive arrangements, whereby:

the plurality of hydraulic linear drive arrangements are hydraulically driven, and application of each mountain-grinding cutterhead of the plurality of mountain-grinding cutterheads against the front surface is driven by hydraulic power.

13. The arrangement according to claim 12, further comprising a plurality of pressure sensors arranged for the plurality of hydraulic linear drive arrangements, the plurality of pressure sensors being for sensing a hydraulic pressure in each hydraulic linear drive arrangement and thereby the feeding force on each cutterhead, whereby:

the arrangement is configured to exchange a subsequent mountain-grinding cutterhead of the plurality of mountain-grinding cutterheads for a projected mountain-grinding condition of the plurality of mountain-grinding cutterheads having larger radial distance, compared to a previous cutterhead of the plurality of mountain-grinding cutterheads, from the centre of the rotatable drill head to form a subsequent radially outer drill ring; and the exchange takes place by sensing of an application pressure of a previous cutterhead of the plurality of mountain-grinding cutterheads against the front surface using at least one of the plurality of pressure sensors.

14. The arrangement according to claim 10, further comprising at least one of the following components for revolution speed control of the rotatable drill head:

a gearbox, which is arranged between the rotatable drill head and a drive motor for rotation of the rotatable drill head; or an inverter arranged for the drive motor.

15. A full face reaming machine for powering holes in mountains, the full face reaming machine comprising the arrangement according to claim 10.

* * * * *